United States Patent [19]

Schlinsog et al.

[11] Patent Number: 4,612,107

[45] Date of Patent: Sep. 16, 1986

[54] DEVICE FOR HOLDING HOLLOW BODIES

[75] Inventors: Hans-Jürgen Schlinsog, Cremlingen; Siegfried Kowalzik, Wuppertal, both of Fed. Rep. of Germany

[73] Assignee: Herberts Gesellschaft mit beschrankter Haftung, Wuppertal, Fed. Rep. of Germany

[21] Appl. No.: 692,026

[22] Filed: Jan. 16, 1985

[30] Foreign Application Priority Data

Jan. 28, 1984 [DE] Fed. Rep. of Germany ..... 3402911

[51] Int. Cl.[4] ..... C25D 13/14

[52] U.S. Cl. ..... 204/300 EC; 204/180.7; 204/299 EC; 204/297 R; 204/297 W

[58] Field of Search ..... 204/180.7, 300 EC, 297 W, 204/297 R, 299 EC

[56] References Cited

U.S. PATENT DOCUMENTS

| | | | |
|---|---|---|---|
| 3,253,943 | 3/1963 | Mayer et al. | 427/235 |
| 3,694,336 | 9/1972 | Fiala | 204/300 EC X |
| 3,759,810 | 9/1973 | Landauer et al. | 204/300 EC X |
| 3,785,952 | 1/1974 | Ritzenhoff | 204/297 W |
| 3,801,485 | 4/1974 | Kossman | 204/300 EC X |
| 3,847,786 | 11/1974 | Landauer et al. | 204/300 EC |
| 4,005,000 | 1/1977 | Kraska | 204/300 EC X |
| 4,107,016 | 8/1978 | Brower, Jr. et al. | 204/300 EC X |
| 4,158,619 | 6/1979 | Brower, Jr. et al. | 204/300 EC X |
| 4,400,251 | 8/1983 | Heffner et al. | 204/299 EC X |

*Primary Examiner*—John F. Niebling
*Assistant Examiner*—B. J. Boggs, Jr.
*Attorney, Agent, or Firm*—Mandeville and Schweitzer

[57] ABSTRACT

A device for holding hollow bodies of electrically conductive material, such as cans of sheet metal, while they are conveyed through an electrophoretic dip bath, is provided with a conveying element which runs through the dip bath, which seizes in succession the open ends of the individual hollow bodies and temporarily holds them. For this purpose, at least three electrically conductive holders for the individual hollow bodies are arranged on the conveying element, which holders are rotatable about a shaft and form gripping devices for seizing, in a detachable manner, the edge of a respective hollow body. The holders are preferably conical pegs, on the surface of the sheath of which threads are arranged as gripping devices, which threads are interrupted at at least one point.

10 Claims, 8 Drawing Figures

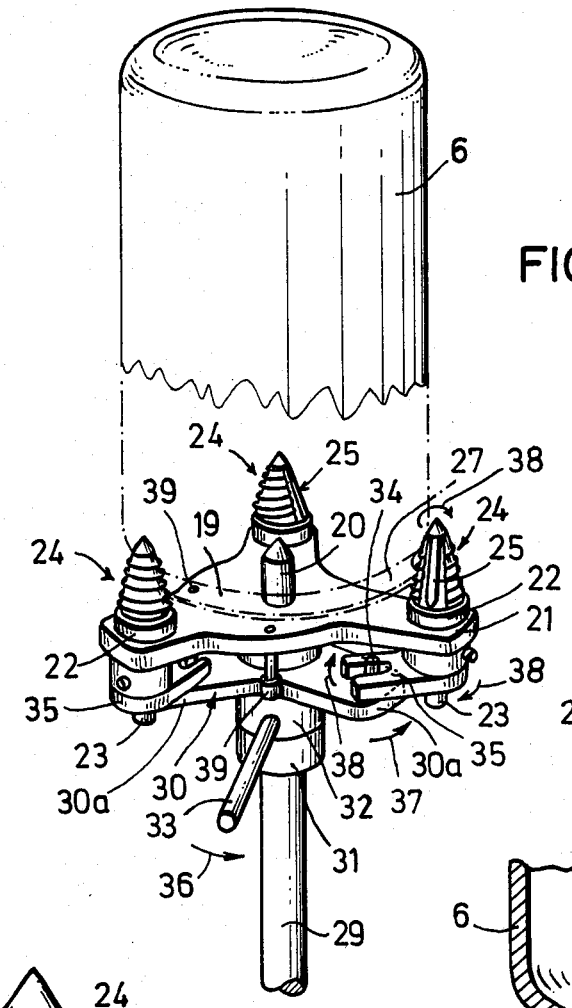
FIG.2
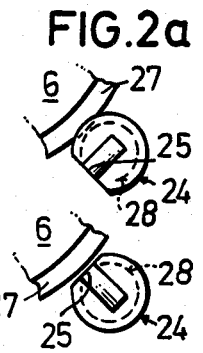
FIG.2a
FIG.2b
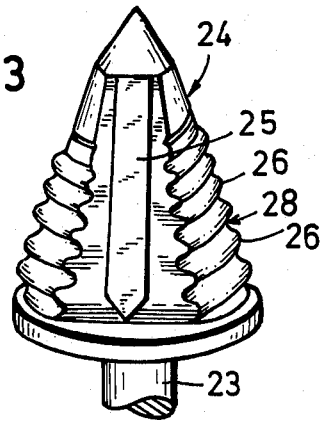
FIG.3
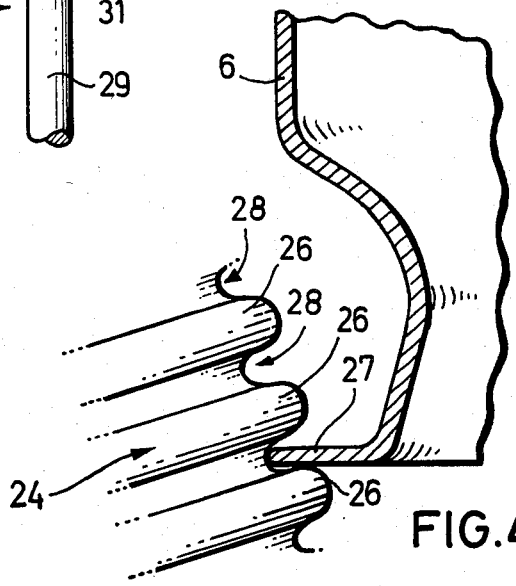
FIG.4

DEVICE FOR HOLDING HOLLOW BODIES

BACKGROUND OF THE INVENTION

This invention relates to a device for holding hollow bodies of electrically conductive material, such as cans made of sheet metal, while they are conveyed through an electrophoretic dip provided with a conveying element which runs through the dip bath and successively seizes the open ends of the individual hollow bodies by their outwardly flanged edge and temporarily holds them.

West German patent application P 33 04 940.8 described a process for coating hollow bodies which are open at one end, in which the individual hollow bodies are washed, coated both outside and inside with a lacquer, then dried, optionally printed and again dried. The hollow bodies, for example cans, are passed in a continuous process through an electro-dip bath such that they are quickly completely flooded with the bath liquid so as to coat them electrophoretically with a wet film. After a sufficient period of coating, the hollow bodies are again lifted from the dip bath and the dip bath liquid contained in them is poured out. During this treatment, the flanged open end of the hollow bodies, i.e., cans, should be gripped, such that the holding device simultaneously serves as a contact electrode, to which an inner counter-electrode, located at a spacing from the wall of the hollow body, is assigned.

While P 33 04 940.8 discloses in detail the process for the electrophoretic coating of hollow bodies which are sealed at one end, for example cans, details of the holding device to be used for carrying out this process are not disclosed therein.

BRIEF SUMMARY OF THE INVENTION

An object of the present invention is to provide a device for holding the hollow bodies to be coated while they are conveyed through the electrophoretic dip bath, suitable for carrying out the process according to P 33 04 940.8, which device reliably and safely seizes the hollow bodies and releases them on leaving the dip bath and which holding devices also ensure a good electrical contact between the holding device which acts as an electrode and the individual hollow bodies.

This object is achieved, according to the invention, by providing a device of the aforementioned type, in which conical holders for the individual hollow bodies are arranged on the conveying element, which holders are rotatable about their longitudinal axis and/or are displacable tangentially to the flanged edge of the hollow bodies and have gripping devices for gripping, in a detachable manner, the flanged edge of a hollow body.

The conical holders, three of which are preferably arranged in a circle at a uniform spacing from each other, can grip or release the outwardly flanged edge of the individual hollow bodies to be coated, such as cans, by being rotated together about their respective longitudinal axis and/or displaced tangentially to the flanged edge. If the holders, in the form of conical pegs, are rotated about their respective longitudinal axis, they seize the outwardly flanged edge of the individual hollow bodies and hold it tightly; the relatively sharp edge of the metallic hollow bodies cutting, as it were, into the surface of the holders and more particularly into a layer of lacquer located there, so that an electrical contact is produced between the holders of the electrically conductive material, which are connected to one pole of the electrical power supply. Thus, the metallic hollow bodies are safely produced. If the holders are displaced tangentially to the flanged edge of the hollow bodies, a similar cutting effect is produced, which can be yet further improved by additionally rotating the holders. As the conical pegs or holders need only have a small diameter, only a very small mechanical switching path is necessary, for example a quarter-turn of the pegs or a short tangential movement is all that is required for both holding the hollow bodies and providing good electrical contact between the hollow bodies, made of electrically conductive material, and the conical peg holders, connected to an electrical power supply.

If the conical pegs or holders have threads, raised splayed guide springs or splayed guide grooves as gripping elements on the surface of their sheath, the distribution or spacing of which depends on the wall thickness of the hollow bodies to be seized, the sharp flanged edge of the hollow bodies, provided with a fin, produces a particularly good cutting movement when the flanged edge of the hollow bodies is held firmly on the holders, in the case of the cans, so that the covering of the coating material on the conical pegs or holders is completely cut through and, accordingly, a perfect electrical contact is made between the holder of electrically conductive material which forms the one electrode and the hollow body to be coated. The contact points formed on the flanged edge between the hollow bodies and the holders, which are not coated in the dip bath, are extremely small and are located only on the outer edge of the flanged edge. These points disappear when the hollow body or the can is sealed with a lid in the fold formed thereby and thus, on the sealed hollow body, they are not subjected to any corrosive influences.

While the hollow bodies are inserted in the holding device and are removed from the holding device, an electrical contact with the holders or rotatable pegs is not practical. Consequently, these holders are, for example, provided with an electrically insulating insert of plastic material or an electrically insulating cap of plastic material, according to a further feature of the present invention. When inserted, the flanged edges of the individual hollow bodies can be displaced onto these electrically insulating parts for centering the cans, without damage being caused to their flanged edge.

When the hollow body is centered between the rotatable pegs or holders, the electrical contact to the conductive part of the individual rotatable pegs is produced by rotating or further rotating the latter pegs about their longitudinal axis, and the flanged edge is held tightly on the rotatable pegs and safely cuts through a covering of coating material on the surface of the hollow bodies or cans.

The device according to the invention provides a flawless mechanical holding device with a self-wiping electrical contact, which ensures the problem-free insertion of the individual hollow bodies to be coated in dip bath coating processes and their unloading onto a conveyor belt or the like after coating without tipping.

It is possible with this device to operate economically within the ten second deposition range with a highly-adjusted deposition voltage, as there are only relatively few point contacts on the flange edge which is, for example, 0.1 mm thick.

The holding device according to the invention can be provided both on dip wheels and on dip beams. The rotating movements of the rotating pegs or conical holders provided for grasping the edges of the cans can be actuated, for example, via a cam control device.

Using the holding device according to the invention, the individual cans are seized by the device so that the cans are reliably prevented from shifting on being immersed in the dip bath and on being lifted out of the bath. The mechanical switching path for seizing and holding or releasing the cans is small and precisely controllable via a cam, for example. The cans are seized and held without risk of shifting or tilting, so that successive cans cannot contact each other, even if the cans are passed through the dip bath in close succession. Owing to the self-wiping effect of the rotating pegs, when seizing the cans, an insulating coating of the coating material of the dip bath cannot form on the parts of the device which act as an electrode. The counter-electrode assigned to the rotating pegs can be extremely small as good coating of the hollow bodies, by virtue of direct electrical contact between hollow bodies and holding pegs, constituting one of the electrical contacts, is now achieved. On the other hand, damage to the cans by the holding device need not be feared.

BRIEF DESCRIPTION OF THE ACCOMPANYING DRAWINGS

FIG. 2 is a perspective view of an embodiment of the holding device according to the invention which can be used in an apparatus according to FIG. 1, with a hollow body or can to be coated shown in phantom;

Figure 1:
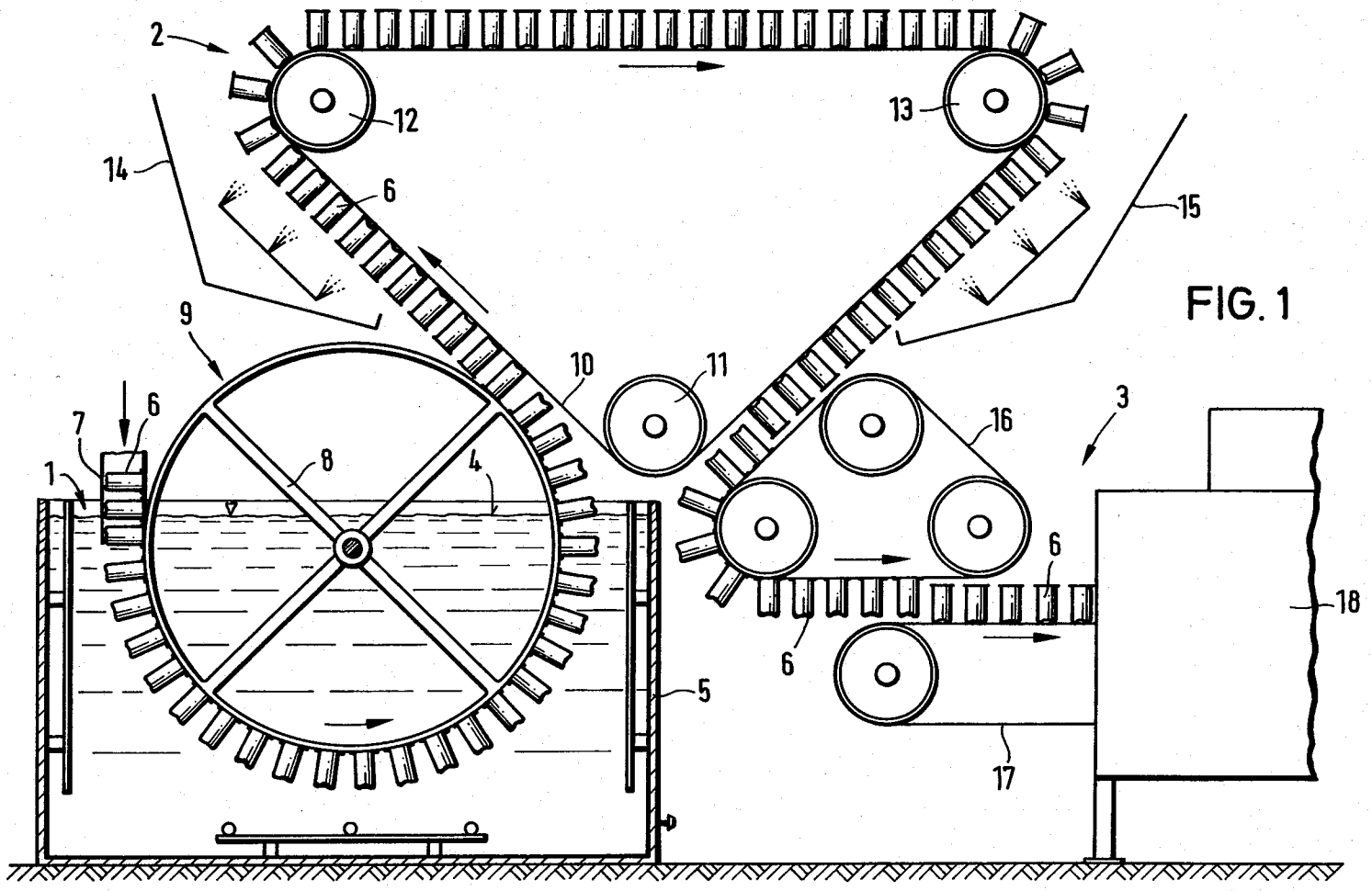
FIG. 1 is a lateral side view of an apparatus for the electrophoretic lacquering of metals cans in a dip bath.
Figure 5:
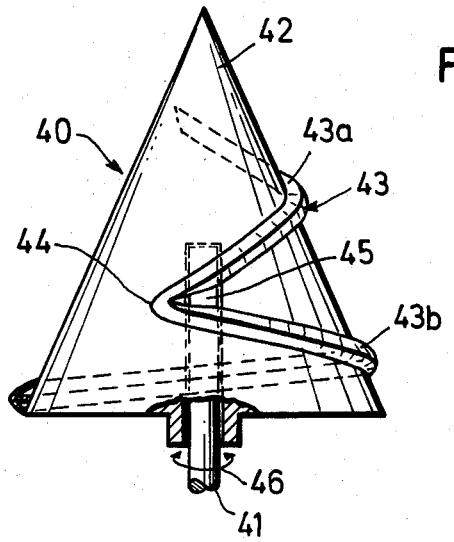
Figure 6:
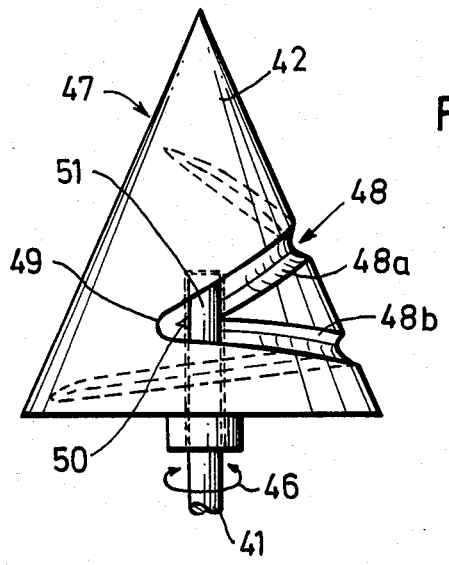

FIG. *2a* is a partial top plan view of a rotatable conical peg of the holding device, which has seized the outwardly flanged edge of a metallic can;

FIG. *2b* is a partial top plan view, as in FIG. *2a*, except that the rotatable peg has released the flanged edge of the metallic can;

FIG. 3 is an enlarged perspective view of a rotatable peg of the device according to FIG. 2;

FIG. 4 is a further enlarged detail of the holding device, illustrating how one of the rotatable pegs seizes and tightly holds the outwardly flanged edge of a metallic can;

FIG. 5 is a perspective view, partly in section of a rotatable peg of the device according to FIG. 2 in an embodiment which has been modified in relation to the embodiment shown in FIG. 3; and FIG. 6 is a perspective view, partly in section of a further modified embodiment of the rotatable peg.

DETAILED DESCRIPTION OF THE DRAWINGS

The dipping section 1 of the dip bath has a dip bath container 5 which is filled with coating liquid 4 for the electrophoretic lacquering of metallic cans 6 which are open at one end.

The individual cans 6 are supplied to the apparatus in a fall gravity shaft 7 and are conveyed through the dip bath 4, 5 by a wheel 8. Holding devices 9 for the individual cans 6 are arranged on the outer periphery of the wheel 8, details of which are shown in FIGS. 2 to 4.

The conveying section 2 comprises a continuous conveyor belt 10, which takes the individual cans 6 after they have been lifted by the wheel 8 out of the dip bath and the liquid contained in them has run out. The conveyor belt 10 runs via deflection rollers 11, 12 and 13, one of which is driven, and at least one of which can be adjusted to maintain the tension of the belt. Blowing devices 14 and 15 for the preliminary drying of the cans 6 on the conveyor belt 10 are provided on the outside of the conveyor belt 10.

A further continuous conveyor belt 16 is provided between the conveying section 2 and the drying section 3, which conveyor belt 16 takes the cans 6 from the conveyor belt 10 and places them, open end upwards, onto a horizontal conveyor belt 17 which conveys the cans 6 through a drying oven 18.

As the coating operation in the dip bath 4, 5 is electrophoretic, the individual cans 6 have not only to be seized by the rotatably mounted wheel 8 on the dip bath container 5, but have also to be connected to an electrode. The holding devices 9 provided on the outer periphery of the wheel 8 are, therefore, simultaneously designed as electrodes which are connected to one pole of an electrical power supply which is not shown.

Each holding device 9 has, as shown by FIG. 2, a bearing plate 19, on which a projecting pin 20 is centrally fixed, which pin, like the bearing plate 19, also consists of electrically conductive material. The bearing plate 19 is connected to the other pole of the power supply, so that the peg 20 serves as a counter-electrode which projects inside of each can 6 but which should not contact the can.

Radially projecting arms 21 are provided on the outer periphery of the bearing plate 19, through each of which an aperture is drilled, in which a bushing 22 of electrically insulating material is inserted, for example of plastics material with self-lubricating properties. The individual bushings serve as a bearing for the shaft 23 of a conical rotating peg 24. The rotating pegs 24, including their shaft 23, are also of electrically conductive material and are connected, in an insulated manner, to the other pole of the electrical power supply by the bearing plate 19. Accordingly, the pin 20 and the rotating pegs 24 form the two counter-electrodes necessary for electrophoretically coating the cans 6.

Each rotating peg 24 contains an insert 25 of electrically insulating material, such as ceramic or plastic material, which extends substantially along its height. The inserts 25 serve as a slide and centering path for the cans 6 to be attached to the holding device 9, if the rotating pegs 24 are in the position shown in FIG. *2b*.

The rotating pegs 24 have, on the surface of their sheath, threads 26 which grip the outwardly flanged edge 27 of the individual cans 6 if the rotating pegs 24 are rotated from the position shown in FIG. *2b* by about a quarter-turn into the position shown in FIG. *2a*. The open end of the can 6 is thereby gripped and tightly held on the holding device 9. FIG. 4 shows that the outwardly flanged edge 27 of the can 6 penetrates deep into the groove 28 between the individual threads 26 and thus cuts into a covering of dip bath liquid, not shown in the drawings, which otherwise covers the rotating peg 24. This, then produces a good electrically conductive contact with the rotating pegs 24.

The grooves 28 between the threads 26 have a U-shaped cross-section so that the outermost edge of the flanged edge 27 is not crushed between the threads 26 and thereby damaged. FIG. 4 clearly shows this.

The bearing plate 19 is fixed to the outer end of a shaft 29, according to FIG. 2. A star-shaped switching member 30 is mounted in a rotatable manner on the shaft 29 below the bearing plate 19, which member is fixed to a bearing bush 32 which is held in a rotatable manner on the shaft 29 and is supported on a stop ring 31, which bearing bush is provided with a control rod 33 which co-operates with a control cam of the apparatus, which is not shown, in order to produce the rotating movements of the rotating pegs 24 desired in each case.

A pin 34 is fixed on each of the radial arms 30*a* of the switching element 30, which pin engages into an open fork 35 which is fixed at the bottom of one of the bushings 22 respectively and, like this, can also be of electrically conductive material. The switching element 30 is swung in the direction of the arrow 37 by swinging the lever 33 in the direction of the arrow 36, so that the three forks 35 are swung in an opposite direction, that is in the direction of the arrows 38. Accordingly, the rotating pegs 24 are also swung in the direction of the arrows 38.

Stops 39 limit the adjustability of the switching element 30 to about a quarter-turn of the rotating pegs 24.

The rotating peg 40, shown in FIG. 5, has a peg 41 of electrically conductive material, on the top of which a conical cap 42 of electrically insulating material is placed. A guide spring 43 projecting above the surface of the sheath is provided on the conical sheath of the cap 42, the upper part 43*a* of which has a right-handed twist and the lower part 43*b* of which has a left-handed twist. Both parts 43*a* and 43*b* of the guide spring 43 run together at a point 44, in the region of which an electrically conductive contact 45 lies on the surface of the conical sheath, which is connected in an electrically conductive manner to the electrically conductive peg 41. The hollow bodies 6 gripped by such a rotating peg 40 contact this contact 45 with their outwardly flanged edge 27 if they are fixed to this contact, after rotation of the rotating peg 40, so that the supply of electric current necessary for the electrophoretic coating operation is ensured.

For this purpose, the peg 41 is connected to one pole of an electric power supply which is not shown. The peg 41 is mounted in a rotatable manner, corresponding to the double arrow 46, in order to rotate the rotating peg 40 so that it grips tightly or releases the hollow bodies 6.

The rotating peg 47 shown in FIG. 6 is distinguishable from the rotating peg 40 shown in FIG. 5 merely in that a guide groove 48 is provided in the surface of the sheath of the cap 42, designed as an insulator, the top 48*a* of which groove has a right-handed twist and the bottom 48*b* of which has a left-handed twist. The cap 42 has an opening 50 in the region of the point 49 of the guide groove 48, in which opening 50 a contact 51 is provided, which is connected in an electrically conductive manner to the electrically conductive peg 41 and serves as a current supply device to the outwardly flanged edge 27 of a hollow body 6 which is seized and gripped by the rotating peg 47.

What we claim is:

1. A device for selectively holding and releasing hollow bodies of electrically conductive material, such as cans of metal, while they are conveyed through an electrophoretic dip path provided with a conveying element which runs through the dip bath and seizes, in continual succession, the open ends of the individual hollow bodies by their outwardly flanged edge and temporarily holds them, wherein conical holders for the individual hollow bodies are arranged on the conveying element, which conical holders are movable and have gripping devices for gripping, in a detachable manner, the flanged edge of the hollow body.

2. A device according to claim 1, wherein each of said conical holders has threads as said gripping device, said threads being located on the surface of said conical holders, said threads being interrupted at least at one point.

3. A device according to claim 1, wherein each conical holder has raised splayed guide rings comprising a direction of twist as said gripping devices on the surface of said conical holders.

4. A device according to claim 1, wherein each conical holder has guide grooves with a directon of twist as said gripping devices.

5. A device according to claim 1, wherein each conical holder is of electrically conductive material and is connected to a first pole of an electrical power supply.

6. A device according to claim 5, wherein each conical holder comprises an insert of electrically insulating material which interrupts said gripping devices, said insert extending along a directrix.

7. A device according to claim 5, wherein the top of each conical holder is provided with a cap of electrically insulating material said cap being providing with guide springs which lead to the electrically conductive core of said conical holder.

8. A device according to claim 5, wherein the top of each conical holder is provided with a cap of electrically insulating material, said cap being provided with guide grooves which lead to the electrically conductive core of said conical holder.

9. A device as claimed in claim 1, wherein said conical holders are movable by rotation about their longitudinal axis.

10. A device as claimed in claim 1, wherein said conical holders are movable by tangential displacement with respect to the circularly flanged edge of said hollow bodies.

* * * * *